United States Patent [19]

Tapio et al.

[11] 4,139,410

[45] Feb. 13, 1979

[54] METHOD OF DEWATERING AND DRYING IN A YANKEE MACHINE

[76] Inventors: Olli Tapio, Aatoksenkatu 10, 40720 Jyvaskyla 72; Lassi Veijonen, Kangaskatu 17, 40630 Jyvaskyla 63; Kalevi Riihinen, Tohlopinkatu 46, 33310 Tampere 31, all of Finland

[21] Appl. No.: 847,590

[22] Filed: Nov. 1, 1977

Related U.S. Application Data

[63] Continuation-in-part of Ser. No. 694,319, Jun. 9, 1976, abandoned.

[51] Int. Cl.[2] ..... D21F 3/04; D21F 5/02; D21F 11/02

[52] U.S. Cl. ..... 162/206; 162/359; 162/360 R

[58] Field of Search ..... 162/205, 206, 290, 305, 162/358, 359, 360 R, 207

[56] References Cited

U.S. PATENT DOCUMENTS

| | | | |
|---|---|---|---|
| 2,415,350 | 2/1947 | Hornbostel et al. | 162/290 |
| 3,198,695 | 8/1965 | Justus | 162/359 |
| 3,691,010 | 9/1972 | Krake | 162/206 |
| 4,016,032 | 4/1977 | Kankaanpaa | 162/305 |
| 4,056,433 | 11/1977 | Koponen et al. | 162/290 |
| 4,075,056 | 2/1978 | Ely et al. | 162/305 |
| 4,086,131 | 4/1978 | Rempel et al. | 162/205 X |

FOREIGN PATENT DOCUMENTS

| | | | |
|---|---|---|---|
| 1078634 | 8/1967 | United Kingdom | 162/360 R |
| 364714 | 3/1973 | U.S.S.R. | 162/290 |

*Primary Examiner*—Richard V. Fisher

*Attorney, Agent, or Firm*—Roylance, Abrams, Berdo & Kaul

[57] ABSTRACT

A Yankee paper machine, particularly for the production of MG (machine glazed) paper and creped tissue, in which the formed paper web is sandwiched between a Yankee felt and a lower felt, pressed in a first nip between a suction roll and a dewatering roll, carried on the Yankee felt around the suction roll and pressed in a second nip between the suction roll and a Yankee cylinder. The web is adhered to the Yankee cylinder and the Yankee felt is detached from the web, passed around separate rolls and returned to the web on the Yankee cylinder in a third nip which in which adherance of the web to the Yankee cylinder is assured.

10 Claims, 1 Drawing Figure

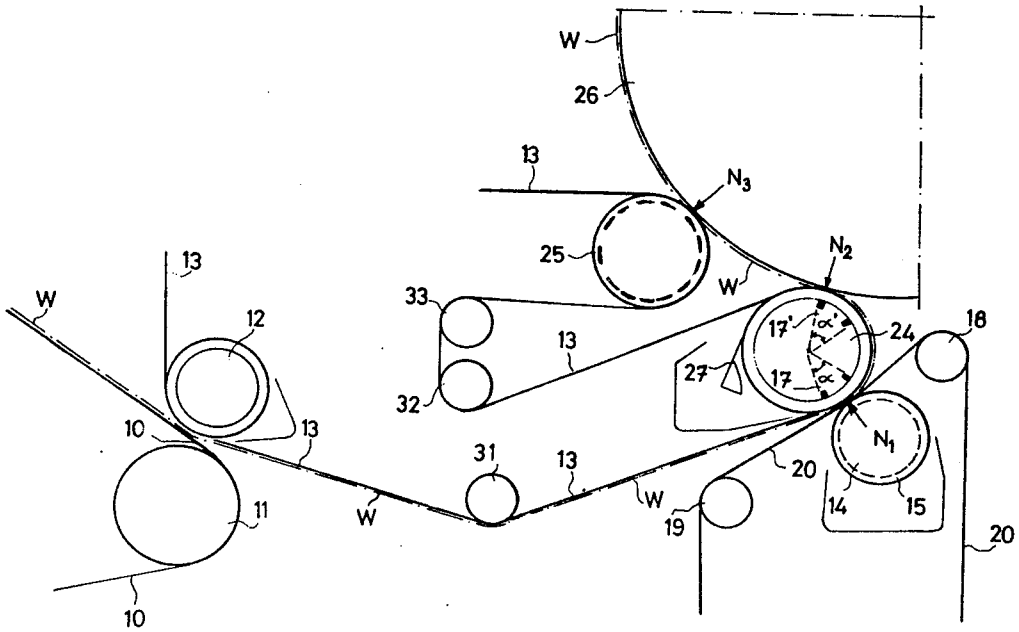
W
26
13
N3
25
N2
W
24
17'
17
α
α
27
13
33
32
18
20
N1
15
14
20
19
W
13
31
W
13
12
13
10
11
10
W

METHOD OF DEWATERING AND DRYING IN A YANKEE MACHINE

This invention relates to paper manufacturing methods and to paper machine construction in connection with a Yankee paper machine. This application is a continuation-in-part of U.S. application Ser. No. 694,319, filed June 9, 1976, now abandoned.

BACKGROUND OF THE INVENTION

The Yankee paper machine differs from the multi-cylinder paper machine in that the common Yankee machine has only one large drying cylinder with the aid of which the paper is dried. The web travels around this cylinder tightly adhered to its heated outer surface, extending around nearly the entire circumference of the cylinder, during which it usually dries completely. The diameter of this cylinder can be in the order of 5–6 meters, while the cylinders of the multi-cylinder paper machine commonly are 1.5 or 1.8 meters in diameter. As the web is adhered to the hot Yankee cylinder surface continuously during drying for a circumferential distance of from 10 to 15 meters without being loosened from the cylinder surface, this kind of paper making process and the paper made thereby differs considerably from the paper making on a multi-cylinder paper machine.

It is also possible to build paper machines in which a Yankee dryer is combined with a number of standard dryers in different ways.

One grade of paper made on a Yankee paper machine is the so-called "machine glazed" or MG paper which is characterized by having a high glaze on one side, the other side being more or less coarse.

Currently, Yankee paper machines are usually used for making creped papers. The most widely used and most important group of the creped papers is the so-called creped tissue grades, for example, facial tissue, napkin tissue, toilet tissue and toweling tissue.

The term creping refers to a process by which certain characteristics of paper are being improved such as, for example, the softness, absorbing capacity, stretch, and the like. The creping is produced by doctoring the paper web off the Yankee cylinder surface with the aid of a doctor blade. When the web runs against the doctor blade, it becomes creped, which means that horizontal wrinkles or waves are formed in the web transverse to the direction of travel of the web.

The adhesion of the web onto the cylinder surface has a great influence on the quality of the paper manufactured, whether it concerns the glaze of MG paper or the crepe properties of the tissue.

A successful creping process demands a web which has a proper adhesion to the cylinder surface at the position of the creping process. If the web is too weakly adhered, it can be partly loosened before the actual creping process. This creates an uneven and rough creping pattern which results in an uneven and low quality product. If the adhesion is too strong, it results in holes in the paper and even breaks on the paper machine.

The degree of adhesion of the wet web to the Yankee cylinder surface depends largely on the moisture content of the web at the moment when it is pressed against the surface of the cylinder. An exact figure for this moisture content cannot be given, because it depends very much on the fiber material used, on the temperature of the Yankee cylinder, on the pressing forces used, etc. In any case, it is clear that the mositure content of the web must be controllable so that the optimal adhesion can be reached.

Also, in manufacturing the MG paper it is desirable to optimize web moisture at the point where the web is pressed against the Yankee cylinder in order to achieve a good glaze for the paper.

In Yankee paper machines previously known, an arrangement has usually been applied wherein the web is detached from the forming wire with the help of a pick-up roll, which operates inside the so-called Yankee felt loop. The web, attached to the lower surface of this Yankee felt, travels then to the first press nip which is formed between the Yankee cylinder and the first press roll. As the web is led directly from the wire to the first nip which is formed against the Yankee cylinder, it is clear that the mositure content of the web at this nip depends solely on the dewatering capacity of the wire section of the paper machine. This drainage capacity in turn depends, for example, on the speed of the machine, basic weight of the web, properties and type of the stock, and other factors.

At present, as efforts are made to operate the machines at higher speeds and as new raw materials are used, such as de-inked waste paper fiber instead of or in addition to conventional chemical pulp and ground wood fibers, it often happens that the mositure content of the web is too high as it enters the first press nip. Therefore, it has become necessary to arrange a separate dewatering press nip between the wire section and the Yankee cylinder before the first Yankee press. This so-called wet press consists of a press roll inside the Yankee felt loop and a lower press roll pressed against it. The lower press roll can operate either without a felt or wrapped by a felt loop of its own. In both cases, it can happen at the wet press that the web does not follow the Yankee felt but drops off, and this causes a break in the machine operation.

BRIEF DESCRIPTION OF THE INVENTION

An object of the present invention is to provide for water removal in the dewatering press assembly situated between the paper machine wire section and a Yankee drying cylinder.

Further, an object of the invention is to provide a method for improving the quality of certain paper grades made and dried on Yankee paper machines, and especially to a method of making creped tissue paper with improved softness.

A further object is to provide a press method in a Yankee paper machine and such a press assembly where it is possible to simultaneously effectively dewater the web and to assure that the web reliably follows the Yankee felt after the first dewatering press nip.

Yet another object is to provide a method wherein the wet pressing and the Yankee pressing are performed by means of one and the same suction press roll, which is properly located underneath the Yankee cylinder and against it, so that the dewatering of the web prior to its entering the Yankee pressing nip is performed in the wet press nip formed against the suction roll by a suitable press roll inside within a felt loop of its own.

In the following description, the term "Yankee pressing" is used. This term refers to the pressing procedure in which the web is pressed against a Yankee cylinder in order to achieve a good adhesion of the web onto the cylinder surface. At the same time, of course, relatively effective dewatering takes place, with the aid of the heat of the hot Yankee cylinder. The heat reduces the viscosity of the water and thus improves its removal from the web.

Briefly described, the invention includes an improved process for the production of a paper web in a Yankee paper machine comprising the steps of adhering a paper web to the lower surface of a Yankee felt, conducting the web, the Yankee felt and a lower felt to a first nip formed between an upper suction press roll and a lower water-receiving press roll, pressing the paper web in the first nip sandwiched between the Yankee felt and a lower felt, dewatering the paper web through both surfaces thereof in the first nip, subjecting the paper web to suction from the suction roll working through the Yankee felt, which felt extends partly around the suction roll, running the paper web on the Yankee felt around the suction roll to a second nip formed between the suction roll and a Yankee drying cylinder, pressing the paper web of the Yankee felt in the second pressing nip and dewatering the paper web in the second nip, adhering the paper web to the surface of the Yankee cylinder, detaching the Yankee felt from the paper web while the web remains adhered to the surface of the Yankee cylinder, and drying the paper web adhered to the surface of the Yankee cylinder.

BRIEF DESCRIPTION OF THE DRAWING

In order that the manner in which the foregoing and other objects are attained in accordance with the invention can be understood in detail, a particularly advantageous embodiment thereof will be described with reference to the accompanying drawing, which forms a part of this specification, and which schematically shows a side elevation of a press design for performing the method of the invention and, as partial views, the related paper machine details cooperating with the press assembly.

DESCRIPTION OF THE PREFERRED EMBODIMENTS

The FIGURE shows an advantageous embodiment of the Yankee paper machine press roll assembly to be used in the method according to the invention. The web W formed on the wire 10 is transferred with the aid of pick-up roll 12 onto the lower surface of a Yankee felt 13. The web W is illustrated in the drawing by a dash-dot line and the return roll for the forming wire 10 is identified at 11. The reference numeral 31 indicates one of the guiding rolls of the felt 13.

The press assembly comprises a lower roll 14 and an upper roll 24, which rolls are rotatably supported in a manner which, in itself, is previously known. The web W to be treated arrives, adhering to the lower surface of Yankee felt 13, at the nip $N_1$ which is defined by the rolls 14 and 24 wherein the web W is interposed between the Yankee felt 13 and a lower felt 20. The rolls 18 and 19 serve as guiding rolls for the lower felt 20. After leaving the nip $N_1$, the web W passes around roll 24 along with Yankee felt 13 and arrives at the nip $N_2$ which is defined by and between the suction roll 24 and a Yankee cylinder 26.

As shown, the suction roll 24 has two relatively narrow suction compartments 17 and 17' at the nips $N_1$ and $N_2$. Corresponding suction zone widths have been denoted by the angle symbols $\alpha$ and $\alpha'$1. These may in certain cases be replaced by one large single suction compartment which, in that event, would extend entirely between the extremes of the two suction units shown. In the nip $N_2$, the web W is pressed tightly against the Yankee cylinder 26 and the web is adhered onto this surface by adhesion forces. During the evaporation beginning in the area of the nip $N_2$, the web tends to loosen from the hot cylinder surface. For securing the adhesion of the web onto the Yankee cylinder, there is a third press nip $N_3$ formed by and between a further press roll 25 wrapped by a felt which, in the simplest arrangement, can be an extension of felt 13, against the Yankee cylinder. Roll 25 is a solid roll having a plain or, preferably, a cavernous surface. The cavities therein may be blind drilled holes or grooves. This roll may be similar to roll 14 described hereinafter.

In the embodiment shown in the FIGURE, the Yankee felt 13 is separated from the web W as the felt and web leave nip $N_2$ and the felt is guided to the nip $N_3$ around felt leading rolls 32 and 33 and then wrapped around roll 25. The Yankee felt 13 may, in certain cases, be arranged to travel together with the web W directly from nip $N_2$ to $N_3$. The felt course shown, however, is preferably because it enables conducting the felt through a felt conditioning device such as, for example, a pair of press rolls, not shown, or any other conditioning device, commonly used to remove water absorbed by felt 13 in the nip $N_2$ prior to the felt reaching nip $N_3$. After leaving the nip $N_3$, the paths of the Yankee felt 13 and web W separate, the web continuing its travel upon the surface of Yankee cylinder 26 until the point at which the web is creped and doctored off.

As shown, the nip $N_1$ is formed between a lower roll 14 and an upper roll 24. Roll 14 can have a recessed or cavernous surface, i.e., the roll can have on its surface grooves 15 or drilled holes, which cavities serve during the pressing process as storage places for the water escaping from the web through the press felt and from which cavities the water can be removed after leaving nip $N_1$ partly by centrifugal force and partly by, e.g., a doctoring device such as the device 27 shown in use with roll 24 or by other common methods previously known in the art. One alternative of this roll design is the fabric roll which is a solid roll covered with a fabric of, for example, plastic material. The meshes of this fabric correspond functionally to the cavities to the above described rolls.

The upper roll 24 is a suction roll which is per se previously known. It has a shell with through-drilled holes and inside the shell there is at least one suction compartment connected to the paper machine system as known in prior art.

Due to the fact that the nip $N_1$ is a double-felted nip with lower felt 20 and Yankee felt 13, and as the rolls 14 and 24 have cavernous surfaces, dewatering in this nip takes place simultaneously in two directions through both faces of the web. This double-sided dewatering is very effective but at the same time relatively gentle. The linear pressure in this nip may be on the order of 60–80 kN/meter (kilo Newtons/meter). The good water removal efficiency relies partly on the fact that the contact line between the press rolls, which is felted on both sides, is relatively wide which, in turn, means that the pressing time is relatively long. As the contact line is wide, the specific pressure to which the web is subjected is lower than it would be if the contact line were narrow. This relatively cautious or gentle pressing results in relatively porous structure of the web after the nip which is in some cases desirable in view of the required properties of the end product.

After leaving the nip $N_1$, the web W is detached from the felt 20 and adhered to the felt 13 by suction. The suction prevailing at the press roll sector between nips $N_1$ and $N_2$ keeps the web effectively on the surface of felt 13 in spite of centrifugal forces. Thus, the web is reliably conducted to the following nip $N_2$ which is the Yankee pressing nip proper. As explained earlier, this nip has two functions, the first being to cause adhesion of the web onto the Yankee cylinder surface, and the second being to continue the water removal from the web. As the structure of the web when entering this nip has already solidified enough, a relatively high nip pressure, in the order of 70–90 kN/meter may be applied. The dryness of the web is increased in this nip to a value of about 35–40% by weight depending on such factors as the machine speed, web thickness, or other paper making variables. It has been proven that a good adhesion to the cylinder surface is achieved when the web dryness after nip $N_2$ is about 36–38% by weight. This, however, may require further Yankee pressing in an additional nip. This figure relates to certain machines making tissue from virgin sulfite pulp fibers at a speed of 900 meters per minute. As mentioned, conditions which affect the process on a paper machine may vary considerably and, correspondingly, also the web dryness varies in different parts of the web during its run through the machine.

As mentioned above, the evaporation of water from the sheet at the hot nip $N_2$ may in some instances cause loosening of the web from the cylinder surface. Therefore, a further nip $N_3$ for Yankee pressing is necessary. This nip $N_3$ usually allows higher line pressures, up to 80–100 kN/meter than in preceding nips $N_1$ and $N_2$. As the temperature is already increased during the pressing in $N_2$ and during the web run between $N_2$ and $N_3$, an effective water removal at nip $N_3$ takes place so that the dry matter content of the web is increased up to 40–45% after that nip.

After having secured a proper web adhesion to the Yankee cylinder surface, the web can be subjected to the normal Yankee drying process which is known to the prior art and which is performed, for example, by a common so-called high velocity hood (not shown). The dry web is then detached from the Yankee cylinder by a creeping doctor if creped tissue is to be made or by common methods if MG paper is made.

It will be seen that the primary advantages of the method and system according to the invention are as follows.

In the first press nip $N_1$ an effective dewatering is accomplished, even at high speed, which results in desired control of the dryness of the web entering the Yankee pressing nip $N_2$. Correspondingly, the adhesion of the web to the cylinder surface can be reliably attained. The heat economy of the drying process is improved. Due to the cautious pressing, porosity of the web is increased, compared with a process wherein the first dewatering pressing takes place in the Yankee press nip. Web porosity improves the softness of creped tissue.

The method requires only one suction roll. Due to its location, the press assembly becomes very compact and space saving, all of this resulting in lower machine and building costs.

By subjecting the web to suction between nips $N_1$ and $N_2$, the web run is secured, resulting in improved machine running efficiency.

In some cases, the effective dewatering at nip $N_1$ may result in sufficiently dry content of the web and its good adhesion to the Yankee cylinder surface after nip $N_2$, thus making the third press nip $N_3$ unnecessary. If the third nip can also be omitted, it is possible to cover the Yankee cylinder with a correspondingly large drying hood and thus improve its evaporation capacity.

While one advantageous embodiment has been chosen to illustrate the invention, it will be understood by those skilled in the art that various changes and modifications can be made therein without departing from the scope of the invention as defined in the appended claims.

What is claimed is:

1. An improved process for the production of a paper web in a Yankee paper machine comprising the steps of adhering a paper web to the lower surface of a Yankee felt, conducting the web, the Yankee felt and a lower felt to a first nip formed between an upper suction press roll and a lower water-receiving press roll, pressing the paper web in the first nip sandwiched between the Yankee felt and said lower felt, dewatering the paper web through both surfaces thereof in the first nip, separating said lower felt from the web;

subjecting the paper web to suction from the suction roll working through the Yankee felt, with the Yankee felt and web extending partly around the suction roll, running the paper web on the Yankee felt to a second nip formed between the suction roll and a Yankee drying cylinder, pressing the paper web on and with the Yankee felt in the second pressing nip so as to dewater said web in said nip, adhering the paper web in said second nip to the surface of the Yankee cylinder, detaching the Yankee felt from the paper web while the web remains adhered to the surface of the Yankee cylinder, and drying the paper web while it is adhered to the surface of the Yankee cylinder.

2. A process according to claim 1 and further including providing two suction zones on the suction roll, one opposite each nip.

3. A process according to claim 1 and further including, after the step of pressing the paper web in the second nip, conducting the paper web on the surface of the Yankee cylinder to a third nip defined between a second water-receiving roll and the Yankee cylinder, and passing the Yankee felt and the paper web through the third nip while the paper web remains adherent to the Yankee cylinder surface.

4. A process according to claim 3 wherein the Yankee felt is detached from the paper web after the second nip.

5. A process according to claim 1 wherein the paper web is dewatered in the first and second nips so that the dry matter content of the web is between about 35% and 40% after the nips.

6. A process according to claim 5 wherein the paper web is dewatered in the first and second nips so that the dry matter content of the web is between about 36% and about 38% after the nips.

7. A process according to claim 3 wherein the paper web is dewatered in first, second and third nips so that the dry matter content of the web is between about 40% and about 45% after passing through the three nips.

8. A process according to claim 1 wherein the line pressure in the first nip is between about 60 and about 80 kN/meter.

9. A process according to claim 1 wherein the line pressure in the second nip is between about 70 and about 90 kN/meter.

10. A process according to claim 3 wherein the line pressure in the third nip is between about 80 and about 100 kN/meter.

* * * * *